US011969623B2

(12) United States Patent
Li et al.

(10) Patent No.: US 11,969,623 B2
(45) Date of Patent: Apr. 30, 2024

(54) ELLIPTICAL TRAINER WITH INCLINE ADJUSTMENT MECHANISM

(71) Applicant: REXON INDUSTRIAL CORP., LTD., Taichung (TW)

(72) Inventors: Wen-Tu Li, Taichung (TW); Ssu-Shun Yang, Taichung (TW)

(73) Assignee: REXON INDUSTRIAL CORP., LTD., Taichung (TW)

( * ) Notice: Subject to any disclaimer, the term of this patent is extended or adjusted under 35 U.S.C. 154(b) by 87 days.

(21) Appl. No.: 17/696,010

(22) Filed: Mar. 16, 2022

(65) Prior Publication Data

US 2022/0296959 A1 Sep. 22, 2022

(30) Foreign Application Priority Data

Mar. 17, 2021 (TW) ..... 110109621

(51) Int. Cl.
*A63B 22/00* (2006.01)
*A63B 22/06* (2006.01)

(52) U.S. Cl.
CPC ..... *A63B 22/0023* (2013.01); *A63B 22/0664* (2013.01)

(58) Field of Classification Search
None
See application file for complete search history.

(56) References Cited

U.S. PATENT DOCUMENTS 5,685,804 A * 11/1997 Whan-Tong ..... A63B 22/0015 482/57
6,168,552 B1 * 1/2001 Eschenbach ..... A63B 22/001 482/52
6,645,125 B1 * 11/2003 Stearns ..... A63B 22/0015 482/52
6,939,271 B1 * 9/2005 Whan-Tong ..... A63B 22/0023 482/52
9,199,116 B1 * 12/2015 Huang ..... A63B 22/001
11,413,497 B2 * 8/2022 Venturella ..... A63B 22/04
2006/0199702 A1 * 9/2006 Eschenbach ..... A63B 22/0015 482/52
2012/0088635 A1 * 4/2012 Lee ..... A63B 22/0664 482/52
2015/0057129 A1 * 2/2015 Lo ..... A63B 22/0664 482/52

(Continued)

*Primary Examiner* — Shila Jalalzadeh Abyaneh
(74) *Attorney, Agent, or Firm* — BACON & THOMAS, PLLC

(57) ABSTRACT

An elliptical trainer with incline adjustment mechanism includes a frame, a link assembly, a pedal assembly and an adjustment mechanism. The frame has a base member and a supporting member. The supporting member defines an inner space. The link assembly has two swinging arms. The pedal unit has two pedal arms. The adjusting mechanism has a shaft, a sleeve member, two coupling members, and two links corresponding to the coupling members. When the sleeve member moves along the shaft, the coupling members and the links are driven by the sleeve member, such that the pedal arms are driven to move relative to the base member. The shaft is disposed in the inner space, preventing the shaft from protruding outward. The coupling members are pivotally connected to the supporting member to evenly distribute the weight of the coupling members and the links.

3 Claims, 5 Drawing Sheets

(56) References Cited

U.S. PATENT DOCUMENTS

| | | | | |
|---|---|---|---|---|
| 2015/0202488 | A1* | 7/2015 | Lo | A63B 22/04 482/52 |
| 2016/0339295 | A1* | 11/2016 | Lin | A63B 21/0059 |
| 2017/0157460 | A1* | 6/2017 | Lin | A63B 69/0057 |
| 2020/0346069 | A1* | 11/2020 | Tracy | A63B 22/001 |
| 2021/0178222 | A1* | 6/2021 | Lo | A63B 22/201 |

* cited by examiner

ELLIPTICAL TRAINER WITH INCLINE ADJUSTMENT MECHANISM

BACKGROUND OF THE INVENTION

1. Technical Field

The present invention is related to an exercise equipment, and in particular, to an elliptical trainer with an incline adjustment mechanism.

2. Description of Related Technology

Please refer to FIG. 1, showing a known elliptical trainer disclosed by Taiwan Patent No. TW 1623340B, comprising a chassis 11, a swing assembly 12, a pedal assembly 13 pivotally attached to the swing assembly 12, a guiding assembly 14 pivotally attached to the pedal assembly 13 and an adjustment assembly 15.

The swing assembly 12 includes two swing arms 121. The pedal assembly 13 includes two pedal arms 131 pivotally attached to the swing arms 121 respectively, and two pedals 132 connected to the pedal arms 131 respectively.

The adjustment assembly 15 includes a driving member 151, a screw shaft 152 driven by the driving member 151 to rotate and extending downward, a nut 153 threaded onto the screw shaft 152, and a linkage member 154 connected to the nut 153.

The guiding assembly 14 includes two connecting rods 141 spaced apart from each other and connected to the linkage member 154 respectively, and two rockers 142 pivotally attached to the connecting rods 141 respectively. One end of each rocker 142 is pivotally attached to its own connecting rod 141 and another end thereof is pivotally attached to its own pedal arms 131 and located underneath its own pedal 132, and the middle section is pivotally attached to the chassis 11.

When the driving member 151 drives the screw shaft 152 to rotate, it is able to drive the nut 153 to move along the screw shaft 152 in order to drive the linkage member 154 and the connecting rods 141 to move, thereby allowing one end of the connecting rod 141 respectively connected to each rocker 142 to generate height difference relative to the chassis 11, such that the inclination angle and slope of the respective pedal shaft 131 can be further adjusted.

Since the known elliptical trainer utilizes the driving member 151 to drive the movement in order to adjust the slope, it is convenient and labor saving during the adjustment. Nevertheless, it still has the following drawbacks:

1. The screw shaft 152 faces toward the front and extends downward. Accordingly, during the transportation, special wrapping is required to prevent collision that may cause bending or breakage of parts that may affect its use. During the use of the equipment, any person passing close to this part of the elliptical trainer may collide with or have clothing trapped by the screw shaft 152 accidentally, leading to hazards.

2. The weights of the connecting rods 141 and the rockers 142 are transmitted to the chassis 11 via the hinge areas between the rockers 142 and the chassis 11. Accordingly, the hinge areas are prone to damage due to the concentration of stress.

3. Since the swing arms 121 are pivotally attached to the front end of the pedal arms 131, the rockers 142 need to extend to the rear from the front of the chassis 11 to be pivotally attached to the rear end of the pedal arms 131 in order to drive the pedal arms 131 to incline and move. Consequently, the length of the rockers 142 are relatively long that may adversely increase the weight of the known elliptical trainer.

BRIEF SUMMARY OF THE INVENTION

In view of the above, an objective of the present invention is to provide an elliptical trainer with an incline adjustment mechanism capable of overcoming at least one drawback of the known art.

Accordingly, the present invention provides an elliptical trainer with an incline adjustment mechanism, comprising a frame, a link assembly, a pedal assembly, a damping assembly and an adjustment assembly.

The frame comprises a base member and a supporting member arranged on the base member. The supporting member includes a rear support and a front support extending upward from the base member and spaced apart from each other, a horizontal support connected between the rear support and the front support, and an inner space defined by the rear support, the front support and the horizontal support.

The link assembly comprises two swinging arms pivotally attached to the supporting member and capable of swinging relative to the supporting member. Each one of the swinging arms includes a hinge portion pivotally attached to the supporting member and a swinging portion arranged opposite from the hinge portion.

The pedal assembly comprises two pedal arms. Each of the two pedal arms includes a front detaining portion and a rear detained portion, and a middle portion arranged between the front detaining portion and the rear detained portion and pivotally attached to the corresponding swinging portions respectively.

The damping assembly is arranged on the supporting member and is capable of providing damping to the pedal arms.

The adjustment assembly comprises a shaft arranged at the inner space, a sleeve member configured to be operable for moving along an extending direction of the shaft, two coupling members pivotally attached to the sleeve member, and two links pivotally attached to the coupling members respectively and pivotally attached to the front detaining portions respectively. Each one of the coupling members includes a first end portion pivotally attached to the sleeve member, a second end portion arranged opposite from the first end portion and provided for the corresponding links to be pivotally attached thereto, and a supporting portion connected to the first end portion and the second end portion and pivotally attached to the supporting member. When the sleeve member moves along the extending direction of the shaft, the coupling members and the links are driven to move in order to drive the front detaining portions of the pedal arms to move relative to the base member, thereby changing a distance between the rear detained portions and the base member.

The technical effect of the present invention includes: Since the shaft is arranged at the inner space, it is able to overcome the hazard due to outward protrusion of the shaft or any inconvenience during transportation. In addition, as the coupling members are pivotally attached to the supporting member, it is able to evenly distribute the weights of the coupling members and the links. Furthermore, since the swinging arms are pivotally attached to the middle portion of the pedal arms respectively, the links can be pivotally attached to the front detaining portions in order to respectively drive the pedal arms to move, such that the length of the links can be reduced, thereby reducing the overall weight.

BRIEF DESCRIPTION OF THE SEVERAL VIEWS OF THE DRAWINGS

Other features and technical effects of the present invention will be illustrated clearly in the accompanied drawings and the embodiments as follows.

DETAILED DESCRIPTION OF THE INVENTION

Figure 1:
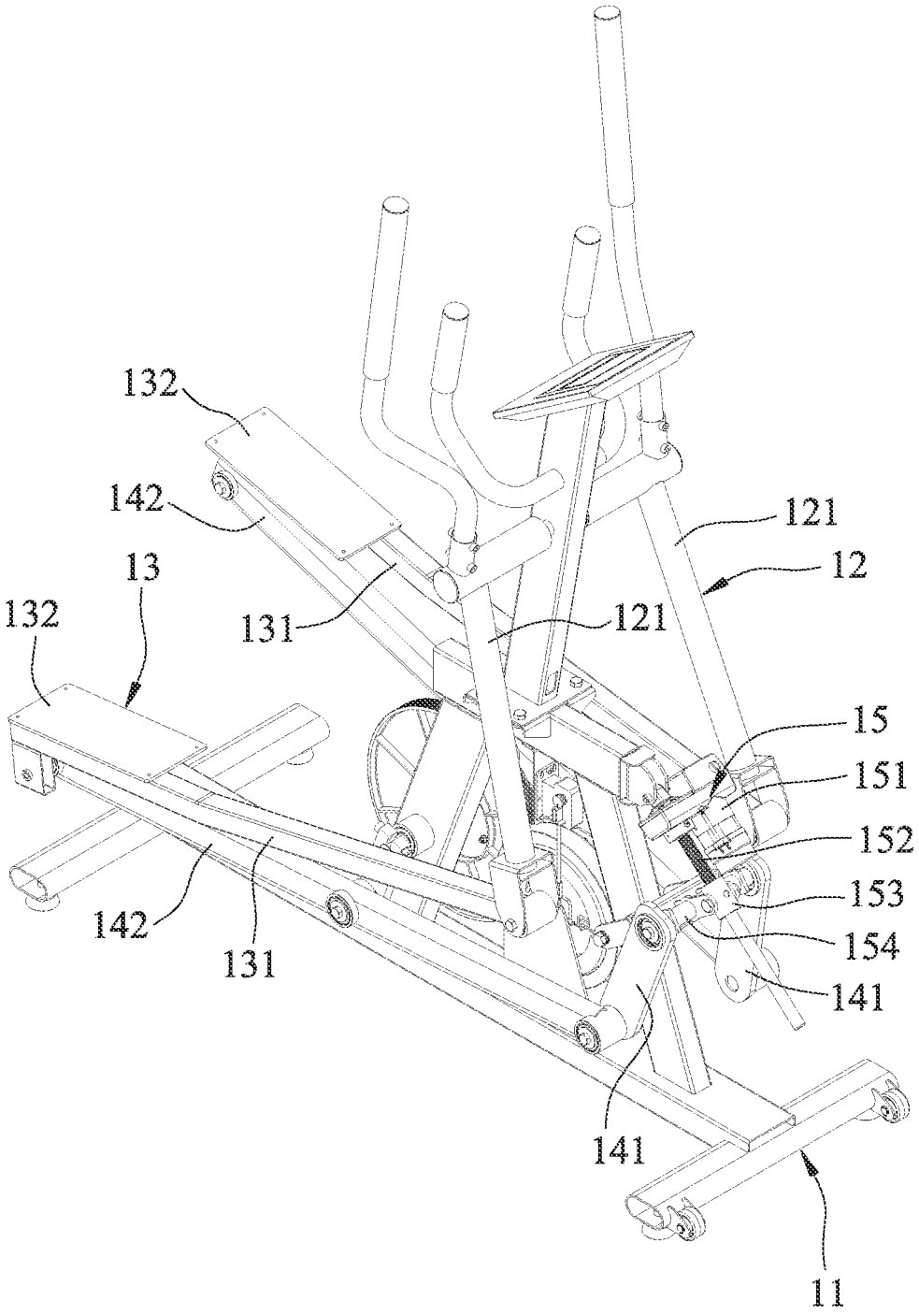
FIG. 1 (PRIOR ART)
FIG. 1 is a perspective view of a known elliptical trainer.
Figure 2:
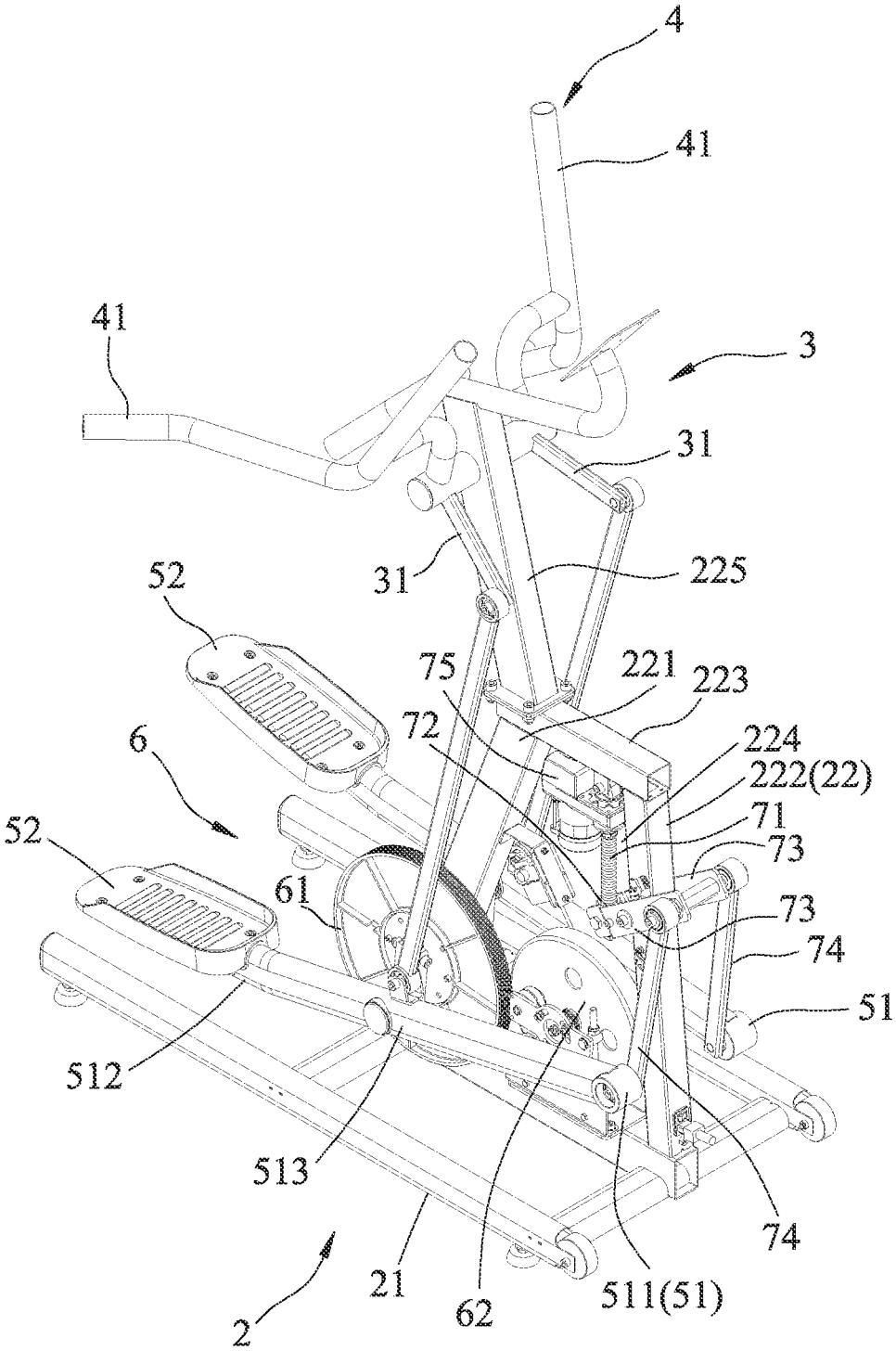
FIG. 2 is a perspective assembly view of an embodiment of the elliptical trainer with an incline adjustment mechanism of the present invention.
Figure 3:
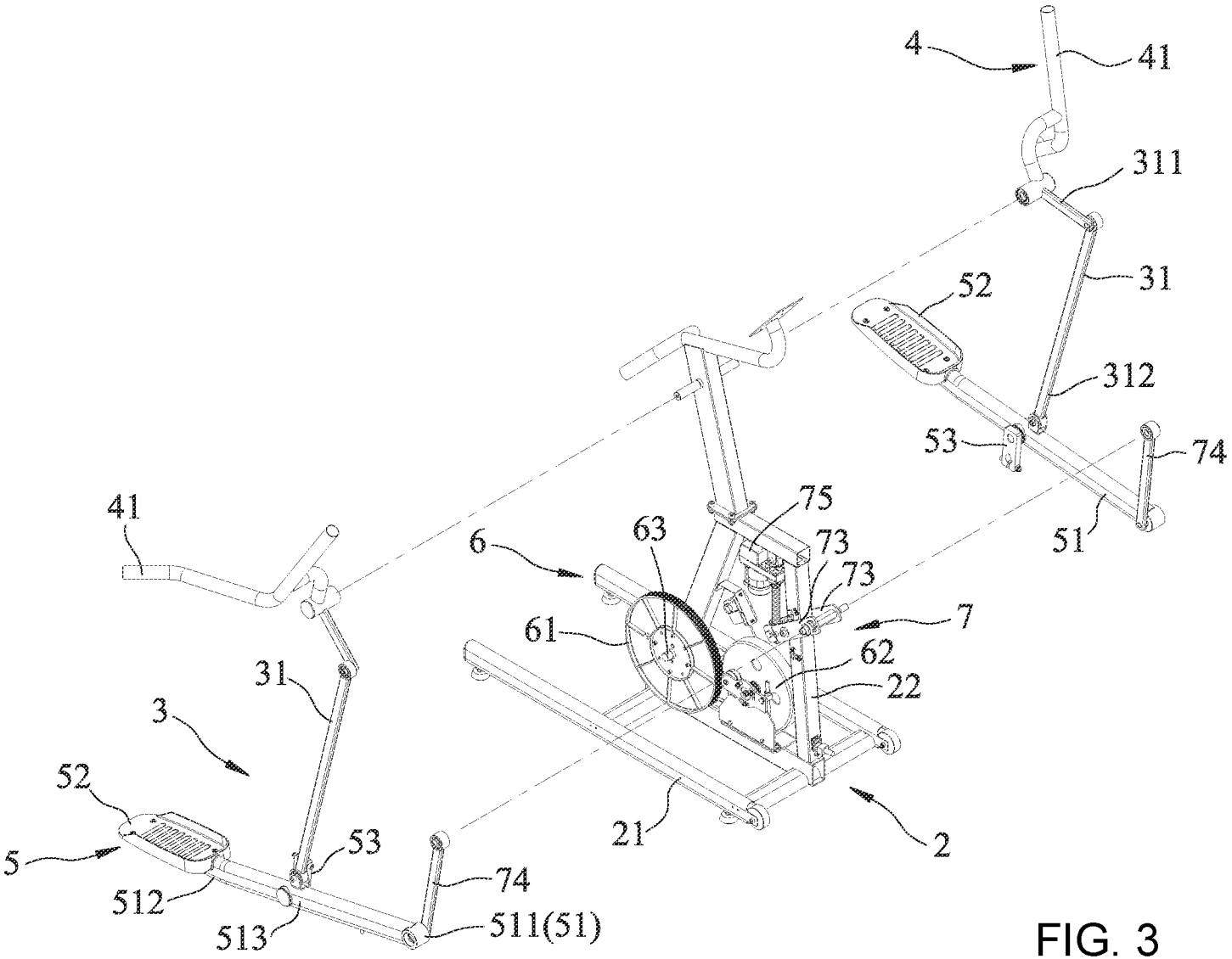
FIG. 3 is a perspective exploded view of the embodiment of the present invention.
Figure 4:
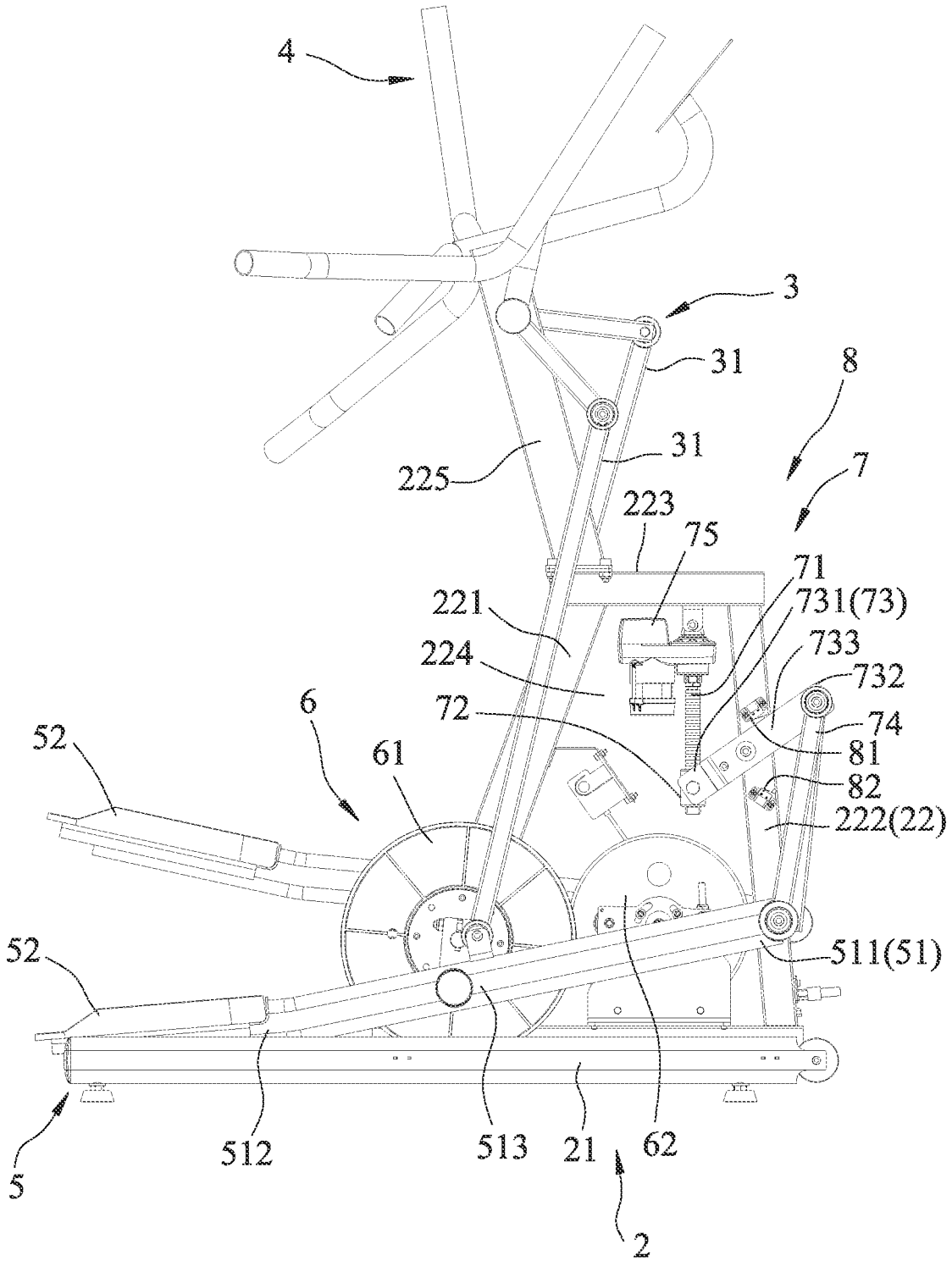
FIG. 4 is a right side view of the embodiment, illustrating a sleeve member at a first position relative to the base member, the sleeve member is relatively close to the base member, the two rear detained portions are relatively close to the base member, and one of the coupling members abuts against an upper positioning member.
Figure 5:
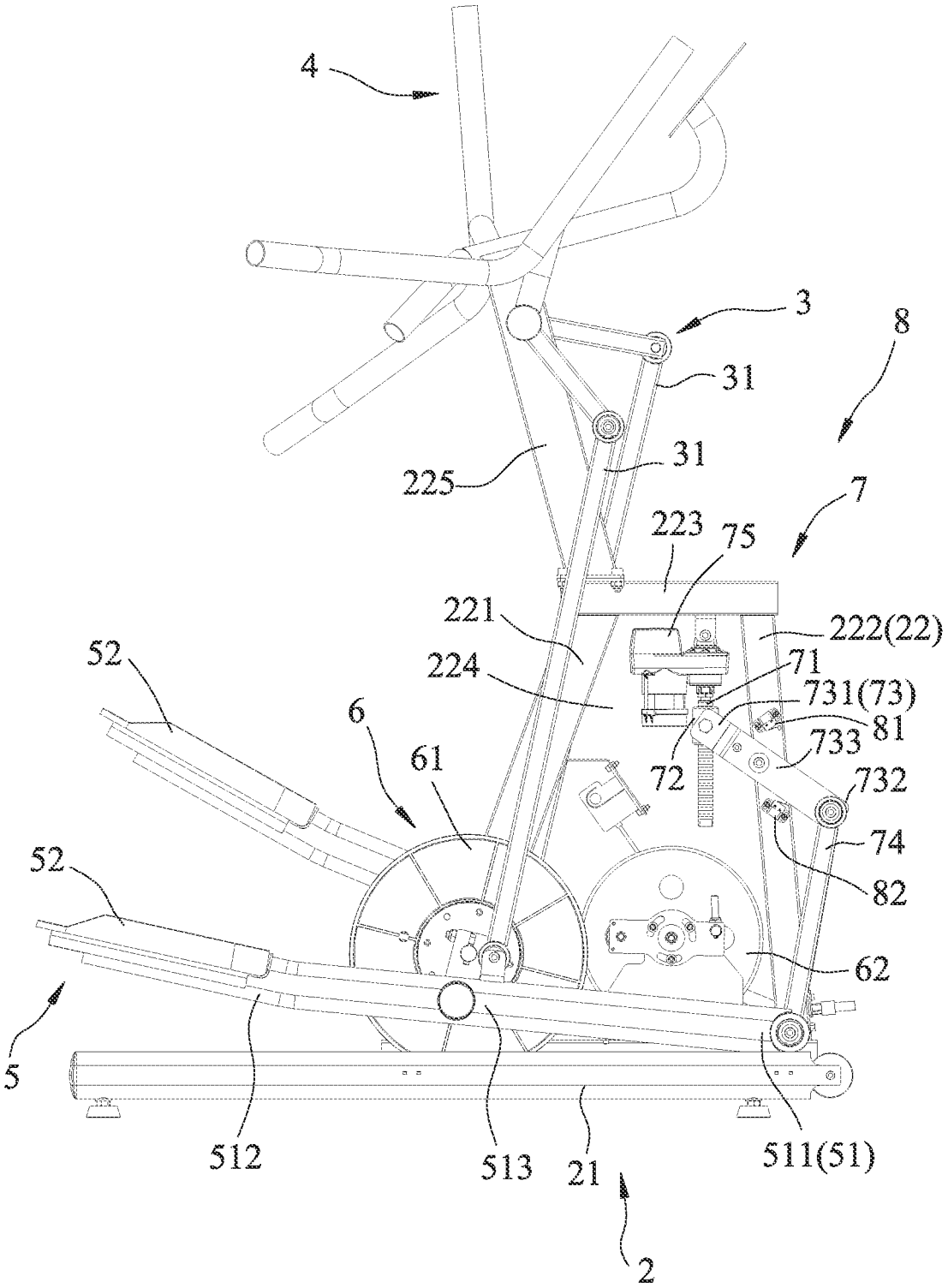
FIG. 5 shows a view similar to FIG. 4, illustrating that the sleeve member is at a second position relative to the base member, the sleeve member is relatively away from the base member, the rear detained portions are relatively away from the base member, and one of the coupling members abuts against a lower positioning member.

Please refer to FIG. 2 to FIG. 5, showing an embodiment of an elliptical trainer with an incline adjustment mechanism of the present invention, comprising a frame 2, a link assembly 3, a handle assembly 4, a pedal assembly 5, a damping assembly 6, an adjustment assembly 7 and a positioning assembly 8.

The frame 2 comprises a base member 21 and a supporting member 22 arranged on the base member 21. The supporting member 22 includes a rear support 221 and a front support 222 extending upward from the base member 21 and spaced apart from each other, a horizontal support 223 connected between the rear support 221 and the front support 222, a vertical support 225 extending upward from the horizontal support 223, and an inner space 224 defined by the rear support 221, the front support 222 and the horizontal support 223.

The link assembly 3 comprises two swinging arms 31 pivotally attached to the vertical support 225 of the supporting member 22 and capable of swinging relative to the supporting member 22. Each of the two swinging arms 31 includes a hinge portion 311 having a first end pivotally attached to the vertical support 225 and a second end, and a swinging portion 312 arranged opposite from the hinge portion 311 and having a first end pivotally connected to the second end of the hinge portion 311 and a second end.

The handle assembly 4 comprises two handles 41 connected to the hinge portions 311 of the swinging arms 31 respectively.

The pedal assembly 5 includes two pedal arms 51, two pedals 52 connected to the pedal arms 51 respectively, and two cranks 53 connected to the pedal arms 51 respectively. Each one of the pedal arms 51 includes a front detaining portion 511 and a rear detained portion 512, and a middle portion 513 arranged between the front detaining portion 511 and the rear detained portion 512 and pivotally attached to the second end of a corresponding one of the swinging portions 312 respectively. The pedals 52 are connected to the rear detained portions 512 respectively. Each of the two cranks 53 is connected to one side of the middle portion 513 of a respective one of the two pedal arms.

The damping assembly 6 is arranged on the supporting member 22 and capable of providing damping to the pedal arms 51. The damping assembly 6 comprises a rotating wheel 61 pivotally attached to the supporting member 22 and a damping wheel 62 pivotally attached to the supporting member 22 and capable of being driven by the rotating wheel 61. The rotating wheel 61 includes a rotating axle 63 extending along its own axis and pivotally attached to the supporting member 22. The cranks 53 are secured to the rotating axle 63. During the swinging of the pedal arms 51, the cranks 53 can be driven to move in order to rotate the rotating wheel 61.

The adjustment assembly 7 comprises a shaft 71 arranged at the inner space 224, a sleeve member 72 configured to be operable for moving along an extending direction of the shaft 71, two coupling members 73 pivotally attached to the sleeve member 72, and two links 74 pivotally attached to the coupling members 73 respectively and pivotally attached to the front detaining portions 511 respectively, and a driving member 75 arranged at the inner space 224 and capable of driving the shaft 71 to rotate and allowing the sleeve member 72 to move along the shaft 71. In this embodiment, the shaft 71 is a screw shaft, the sleeve member 72 is a nut threaded onto the shaft 71, and the driving member 75 is a servo motor.

Each one of the coupling members 73 includes a first end portion 731 pivotally attached to the sleeve member 72, a second end portion 732 arranged opposite from the first end portion 731 and provided for the corresponding links 74 to be pivotally attached thereto, and a supporting portion 733 connected between the first end portion 731 and the second end portion 732 and pivotally attached to the supporting member 22.

The positioning assembly 8 comprises an upper positioning member 81 and a lower positioning member 82 arranged on the front support 222 and spaced apart from each other.

When the sleeve member 72 of the adjustment member 7 moves along the extending direction of the shaft 71, the coupling members 73 and the links 74 are driven to move in order to drive the front detaining portions 511 of the pedal arms 51 to move relative to the base member 21, thereby changing a distance between the rear detained positions 512 and the base member 21.

The sleeve member 72 is able to move along the extending direction of the shaft 71 and between a first position and a second position relative to the base member 21.

When it is at the first position (see FIG. 4), the sleeve member 72 is relatively close to the base member 21, the rear detained portions 512 are relatively close to the base member 21, and one of the coupling members 73 abuts against the upper positioning member 81, such that the sleeve member 72 is prevented from moving in a direction away from the second position.

When it is at the second position (see FIG. 5), the sleeve member 72 is relatively away from the base member 21, the rear detained portions 512 are relatively away from the base member 21, and one of the coupling members 73 abuts against the lower positioning member 82, such that the sleeve member 72 is prevented from moving in a direction away from the first position.

When a user (not shown in the drawings) uses the elliptical trainer with an incline adjustment mechanism, the user is required to place his or her feet on the pedals 52, and then apply force horizontally and toward the front direction, such that the pedal arms 51 are able to drive the swinging arms 31 to swing, and the cranks 53 are able to drive the rotating wheel 61 to rotate, following which the rotating wheel 61 further drives the damping wheel 62 to rotate in order to generate damping, thereby achieving the purpose of exercise and fitness.

In addition, when the user plans to adjust the slope of the elliptical trainer with an incline adjustment mechanism, he or she can use the driving member 75 to drive the shaft 71 to rotate, in order to allow the sleeve member 72 to move along the extending direction of the shaft 71 and between the first position and the second position relative to the base member 21, thereby changing the distance between the rear detained portions 512 and the base member 21. Consequently, the inclination angle of the pedal arms 51 can be changed; in other words, the slope of the elliptical trainer with an incline adjustment mechanism can be changed.

Since the shaft 71 is arranged at the inner space 224, it is able to overcome the hazard due to outward protrusion of the shaft 71 or any inconvenience during transportation. In addition, as the coupling members 73 are pivotally attached to the supporting member 22, the weights of the coupling members 73 and the links 74 can be evenly distributed. Furthermore, since the swinging arms 31 are pivotally attached to the middle portion 513 of the pedal arms 51 respectively, the links 74 can be pivotally attached to the front detaining portions 511 in order to respectively drive the pedal arms 51 to move, such that the length of the links 74 can be reduced, thereby reducing the overall weight.

Furthermore, with the arrangement of the upper positioning member 81 and the lower positioning member 82, when the sleeve member 72 is at the first position and the second position, the upper positioning member 81 and the lower positioning member 82 can be provided for the abutment of one of the coupling member 73. Accordingly, when one of the coupling members 73 abuts against the upper positioning member 81 and the lower positioning member 82, rotating position limit of one of the coupling members 73 can be reached such that it cannot rotate further, thereby preventing the movement of the sleeve member 72 from exceeding the range of the first position and the second position.

In view of the above, for the elliptical trainer with an incline adjustment mechanism, since the shaft 71 is arranged at the inner space 224, it is able to overcome the hazard due to outward protrusion of the shaft 71 or any inconvenience during transportation. In addition, as the coupling members 73 are pivotally attached to the supporting member 22, the weights of the coupling members 73 and the links 74 can be evenly distributed. Furthermore, since the swinging arms 31 are pivotally attached to the middle portion 513 of the pedal arms 51 respectively, the links 74 can be pivotally attached to the front detaining portions 511 in order to respectively drive the pedal arms 51 to move, such that the length of the links 74 can be reduced, thereby reducing the overall weight. Accordingly, the objective of the present invention can be achieved.

It shall be understood that the above description is provided to illustrate the possible embodiments of the present invention only, and it shall not be treated as limitation to the implementation scope of the present invention. All mere and equivalent changes and modifications made based on the scope of the claims and the content of the specification of the present invention shall be considered to be within the scope of the claims of the present invention.

What is claimed is:

1. An elliptical trainer with incline adjustment mechanism, comprising:

a frame comprising a base member and a supporting member arranged on the base member, the supporting member having a rear support and a front support extending upward from the base member and spaced apart from each other, a horizontal support connected between the rear support and the front support, and an inner space defined by the rear support, the front support and the horizontal support;

a link assembly comprising two swinging arms pivotally attached to the supporting member and configured to swing relative to the supporting member; each of the two swinging arms having a hinge portion and a swinging portion arranged opposite from the hinge portion, the hinge portion having a first end and a second end, the first end of the hinge portion pivotally attached to the supporting member, and the swinging portion having a first end and a second end, the first end of the swinging portion pivotally connected to the second end of the hinge portion;

a pedal assembly comprising two pedal arms, each one of the two pedal arms having a front detaining portion and a rear detained portion arranged opposite from each other, and a middle portion arranged between the front detaining portion and the rear detained portion and pivotally attached to the second end of a corresponding one of the swinging portions respectively;

a damping assembly arranged on the supporting member and configured to provide damping to the pedal arms;

an adjustment assembly comprising a shaft arranged at the inner space, a sleeve member movable along an extending direction of the shaft, two coupling members, each pivotally attached to the sleeve member, and two links, each pivotally attached at a first end to a corresponding one of the two coupling members and pivotally attached at an opposite second end to a corresponding one of the front detaining portions; each one of the two coupling members having a first end portion pivotally attached to the sleeve member, a second end portion arranged opposite from the first end portion and provided for the first end of a corresponding link to be pivotally attached thereto, and a supporting portion connected between the first end portion and the second end portion and pivotally attached to the supporting member; and a positioning assembly, the positioning assembly comprising an upper positioning member and a lower positioning member arranged on the front support;

wherein when the sleeve member moves along the extending direction of the shaft, the two coupling members and the two links are driven to move in order to drive the front detaining portions of the two pedal arms to move relative to the base member, thereby changing a distance between the rear detained portions and the base member;

wherein the sleeve member is movable along the extending direction of the shaft between a first position and a second position relative to the base member; wherein: at the first position, the sleeve member is relatively close to the base member, and the rear detained portions are relatively close to the base member, and at the second position, the sleeve member is relatively away from the base member, and the rear detained portions are relatively away from the base member; and wherein when the sleeve member is at the first position, one of the two coupling members abuts against the upper positioning member to prevent the sleeve member from moving in a direction away from the second position, and when the sleeve member is at the second position, the one of the two coupling members abuts against the lower positioning member to prevent the sleeve member from moving in a direction away from the first position.

2. The elliptical trainer with incline adjustment mechanism according to claim 1, wherein the shaft of the adjustment assembly is a screw shaft, and the sleeve member is a nut threaded onto the shaft; the adjustment assembly further comprises a driving member arranged at the inner space and configured to drive the shaft to rotate and to allow the sleeve member to move along the shaft.

3. The elliptical trainer with incline adjustment mechanism according to claim 1, wherein:

the damping assembly comprises a rotating wheel pivotally attached to the supporting member, and a damping wheel pivotally attached to the supporting member and configured to be driven by the rotating wheel; the rotating wheel includes a rotating axle extending along its own axis and pivotally attached to the supporting member; and the pedal assembly further comprises two cranks, each connected to a corresponding pedal arm of the two pedal arms; the two cranks are secured to the rotating axle, and during swinging of the two pedal arms, the two cranks are driven to move in order to rotate the rotating wheel.

* * * * *